United States Patent [19]

Iwai et al.

[11] 4,297,555

[45] Oct. 27, 1981

[54] MOVABLE CONTACT ARM ASSEMBLY

[75] Inventors: Michinobu Iwai; Akira Tanimoto, both of Mieken, Japan

[73] Assignee: Tokyo Shibaura Denki Kabushiki Kaisha, Kawaski, Japan

[21] Appl. No.: 149,753

[22] Filed: May 14, 1980

[30] Foreign Application Priority Data

May 14, 1979 [JP] Japan ..... 54-063001[U]

[51] Int. Cl.[3] ..... H01H 1/22

[52] U.S. Cl. ..... 200/153 G; 200/153 H; 200/288; 200/244

[58] Field of Search ..... 200/153 G, 321, 153 H, 200/290, 288, 153 SC, 153 R, 244, 245, 250

[56] References Cited

U.S. PATENT DOCUMENTS 3,003,046 10/1961 Torre ..... 200/153 G 3,134,878 5/1964 Jencks ..... 200/153 G 3,134,880 5/1964 Murphy ..... 200/153 G

FOREIGN PATENT DOCUMENTS 1220926 7/1966 Fed. Rep. of Germany ... 200/153 G 47-5724 2/1972 Japan .

*Primary Examiner*—Willis Little

*Attorney, Agent, or Firm*—Oblon, Fisher, Spivak, McClelland & Maier

[57] ABSTRACT

A movable contact assembly for use in a circuit breaker includes a movable contact arm having wall portions and an elongated contact member located adjacent to and between the wall portions of the movable contact arm. A supporting member attached to the back of the elongated contact member is engaged with the movable contact arm by means of a pivot pin passing through a pair of aligned holes.

6 Claims, 5 Drawing Figures

MOVABLE CONTACT ARM ASSEMBLY

BACKGROUND OF THE INVENTION

1. Field of the Invention

This invention generally relates to an electric circuit breaker and switch, and more particularly to a movable contact assembly for use in circuit breakers and switches.

2. Description of the Prior Art

Electrical circuit breakers of the type commonly referred to include a plurality of movable contact arms, each including a rigid contact arm and an elongated contact member having movable contacts pivotally supported on the contact arm. In these devices spring means are provided between the elongated contact member and the contact arm to limit the movement of the elongated contact member away from the rigid contact arm. Such electric circuit breakers are illustrated in Japanese utility model No. 976762 to M. Iida published on Feb. 28, 1972, and in U.S. Pat. No. 3,134,878 to C. L. Jencks issued on May 26, 1964, and U.S. Pat. No. 3,134,880 to F. H. Murphy issued on May 26, 1964.

In the above mentioned Japanese utility model specification, a pair of openings are provided within an elongated contact member to support a pin by a U-shaped supporting member. Similarly, in the device disclosed in both U.S. patent specifications, a pair of openings are provided therein. However, since the cross section of the elongated contact member is reduced due to the various openings, the current capacity of the elongated contact member is restricted. Furthermore, since the elongated contact member is repeatedly moved or operated, adequate mechanical strength of the elongated contact member is required.

In accordance with the teachings of these prior art references, in order to satisfy the condition of adequate circuit capacity and mechanical strength as discussed above, the structure of the prior art electric circuit breaker device requires a great deal of space. Furthermore, since the elongated contact member is surrounded by a movable contact arm and a pivot pin, i.e. a shorting ring, an eddy current flows in the shorting ring when a current flows in the elongated contact member thereby heating the shorting ring. In order to prevent heating generated by the eddy current and to prevent humming or buzzing produced in the shorting ring when the circuit breaker operates, the use of non-magnetic material as the pivot pin is required. As the result, the circuit breaker becomes expensive and the circuit breaker as a whole requires a great deal of space. Moreover, since the elongated contact member is usually made of copper material, it is affected by the eddy current when the circuit breaker is thrown and by mechanical shock when the circuit breaker is tripped. As the result, deformation of the elongated contact member occurs.

SUMMARY OF THE INVENTION

Accordingly, one object of this invention is to provide a new and improved electric circuit breaker including a movable contact arm assembly which is compact and has sufficient mechanical strength without reducing the current capacity of the contact supporting member.

Briefly, in accordance with one aspect of this invention, an electric circuit breaker is provided with at least one movable contact and means for moving the movable contact between the open and closed circuit positions. The circuit breaker includes a movable contact arm having a pair of spaced wall portions which include a pair of aligned holes therein. The movable contact arm further includes a single hole at one end. An elongated contact member is located adjacent to and between the wall portions of the contact arm. A supporting member is mounted on the elongated contact member and is located between the contact member and the contact arm. The supporting member includes a generally L-shaped engaging member at one end and an engaging member at the other end. A pivot pin passing through the aligned holes in the wall portions of the contact arm cooperates with the engaging member of the supporting member such that the contact arm, the support arm, and the contact member are coupled together.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
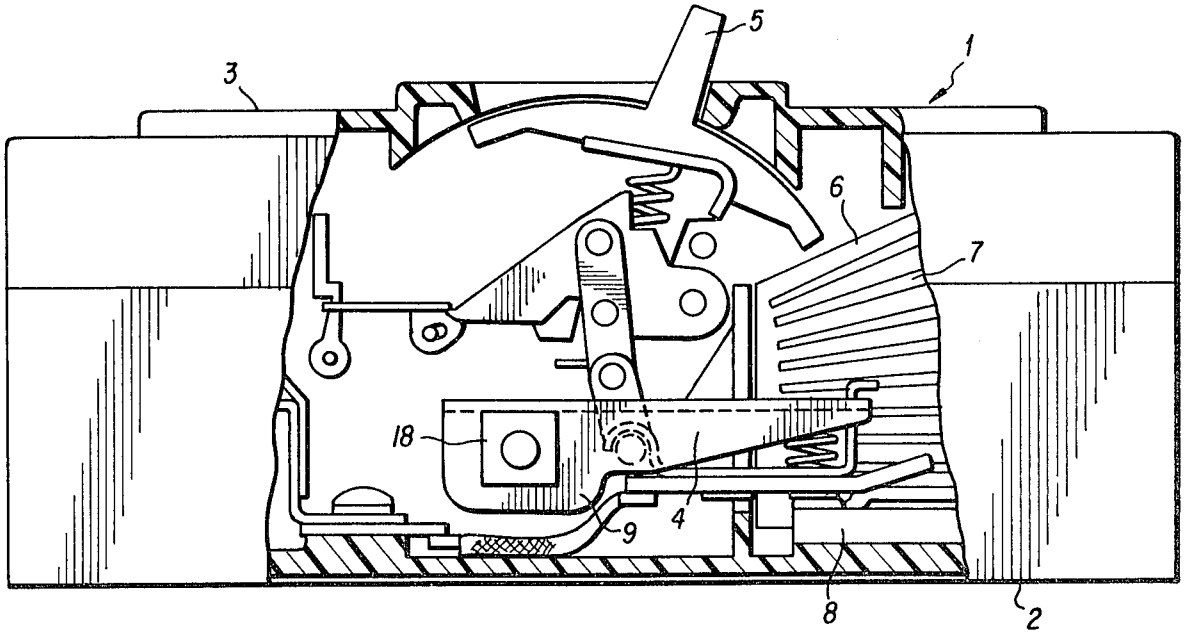
FIG. 1 is a side elevation view, partially in section of an electric circuit breaker according to this invention.

Referring now to the drawings, wherein like reference numerals and letters designate identical or corresponding parts throughout the several views, and more particularly to FIG. 1 thereof, wherein one preferred embodiment of an electric circuit breaker 1 in accordance with this invention is shown as including an insulating casing having a base 2 and a cover 3.

The casing is generally rectangular in shape and includes three line terminals (not shown) at one end and three load terminals (not shown) at the other end. Electrical continuity between each pair of corresponding line and load terminals is adapted to be controlled by a pair of contacts including a relatively movable contact 4 and a stationary contact 8 (only one pair shown). Each of the movable contacts is carried by an elongated contact member or a movable contact member. The contact arm 4 for the center pair of line and load terminals, as illustrated in FIG. 1, is pivotally supported on an insulating pivot pin 18 and engaged with a manually operable handle member 5 through a well known toggle linkage mechanism. In the casing, an arc extinguishing or arc quencher chamber 6 having a plurality of grids 7 is provided along the orbit of the movement of the movable contact. Such an electric circuit breaker is well known as described in the above referenced U.S. patents; therefore, a more detailed description of the structure and the operation of such a prior electric circuit breaker is not undertaken herein.

Figure 2:
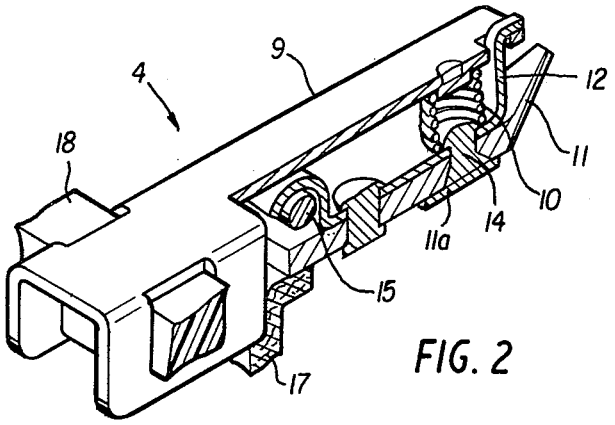
FIG. 2 is a fragmentary elevational view, partially in section, of a portion of the movable contact arm assembly of FIG. 1 showing a supporting member.

In accordance with the present invention, referring particularly to FIG. 2, the movable contact arm assembly 4 comprises a movable contact arm member 9, an elongated contact member 11 including a contact 11*a*, and a supporting member 12, made of rigid material such as iron, which is attached to the contact supporting member 11 by a suitable means such as, for example, rivet means 13 and 14, or by means of welding, brazing, or bolting, etc. A compression spring 10 is mounted between the movable contact arm member 9 and one end portion of the supporting member 12 so as to bias or urge the elongated contact member 11 away from the movable contact arm 9. The supporting member 12 is provided with a generally L-shaped engaging member 12*a* at one end thereof, and an engaging member 12*b* at the other end thereof. The elongated contact member 11, which is mounted on the supporting member 12, is carried by the movable contact arm 9 by means of a carrying pivot pin 15.

Figure 3:
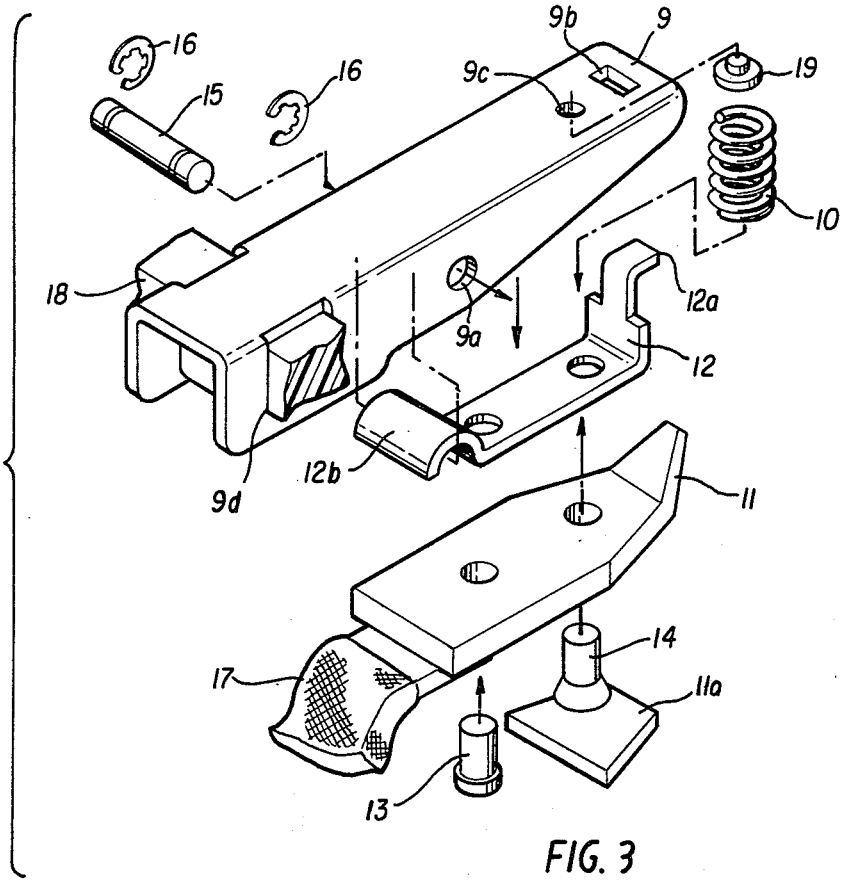
FIG. 3 is an exploded perspective view of the movable contact arm assembly of the circuit breaker of FIG. 1.

Referring to FIG. 3, the movable contact arm includes aligned holes 9*a* for mounting the carrying pivot pin 15, and holes 9*b*, 9*c* and 9*d*. When all three contact arm assemblies of the circuit breaker are assembled, the insulating pivot pin 18 serves to interlock each other. Both ends of the pivot pin 18 are supported by inside wall portions of the casing.

The movable contact 11*a* is silver soldered to the elongated contact member 11. In the embodiment shown in FIGS. 2 and 3 a hollow portion is provided in the elongated contact member 11 to accommodate the head of a rivet 14. By silver soldering the contact 11*a* to the elongated contact member 11 together with the rivet 14, it is possible to rigidly mount the rivet 14 to the elongated contact member 11. A conduit member 17 is connected with the other end of the elongated contact member 11 by a suitable means, such as silver solder, bolting, welding, etc. When the rivet 14 is attached to the elongated contact member 11, a portion projecting through the supporting member 12 is provided to position the compression spring 10. Similarly, a projecting member 19 is mounted in hole 9*c* of the movable contact arm member 9 facing the projecting portion of the supporting member 12 by a suitable mounting means, such as welding, bolting, etc.

The assembly sequence of the parts is as follows: the generally L-shaped engaging member 12*a* of the supporting member 12 is first engaged with the hole 9*b* of the movable contact arm 9. The compression spring 10 is located between the projecting portions 14 of the elongated contact member 11 and 19 of the movable contact arm member 9. Then, the other end (engaging member 12*b*) of the supporting member 12 is moved to a predetermined position, using as a fulcrum the engaging point between the L-shaped engaging member 12*a* and the hole 9*b* of the movable contact arm member 11, so as to locate the elongated contact member 11 into the movable contact arm member 9. Subsequently, the engaging member 12*b* of the supporting member 12 is attached to the movable contact arm member 9 by means of the carrying pivot pin 15 positioned through the aligned holes 9*a* of the wall portions of the contact arm member 9. A suitable retainer means, such as E-shaped rings 16, are then attached to both ends of the carrying pivot pin 15 to prevent the removal of the carrying pivot pin 15 from the contact arm 9. Thus, the carrying pivot pin 15 holds all these arts in assembled relation.

The L-shaped engaging member 12*a* of the support member 12 in conjunction with the hole 9*b* of the movable contact arm 9, serves to limit the movement of the elongated contact member 11. On the other hand, since the engaging member 12*b* of the supporting member 12 is semicircular engaging member with the surface of the carrying pivot pin 15, it is possible to prevent the swinging movement of the elongated contact member 11. Therefore, it is possible to ensure a contacting condition between the contacts and to maintain the contact pressure between the contact. Moreover, since the L-shaped engaging member 12*a* of the supporting member 12 is engaged with the hole 9*b* of the movable contact arm member 9, lateral movement of the elongated contact member 11, the so called the sliding movement, is reduced.

Since the supporting member 12 is provided along the back of the elongated contact member 11, the mechanical strength of th elongated contact member 11 is increased. According to the present embodiment of this invention, since there are no holes in the elongated contact member, the current capacity of the elongated contact member is relatively increased as compared to prior art devices which include holes. Furthermore, when the circuit breaker is closed, as shown in FIG. 1, the compression spring 10 functions to ensure the contact of the elongated contact member 11 with the stationary contact 8 and to maintain a certain contact pressure.

Figure 4:
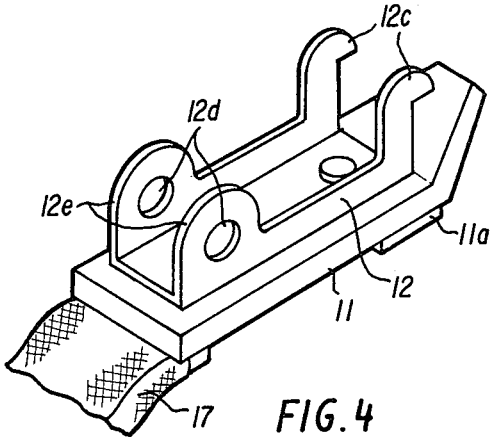
FIGS. 4 and 5 are respectively a perspective view and an elevational view of a portion of a modification of the movable contact arm assembly according to this invention.
Figure 5:
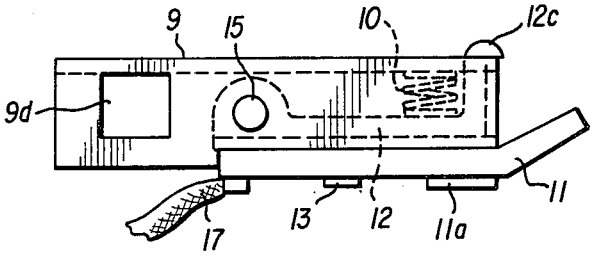

Referring now to FIGS. 4 and 5, an alternative and preferred embodiment according to this invention is shown as having a pair of L-shaped engaging members 12*c* and a pair of engaging members 12*e* each including a hole 12*d* in the supporting member 12. The movable contact arm member 9 has two holes 9*e* (not illustrated) to engage with the L-shaped engaging members 12*c*. According to this embodiment of the present invention, since the holes of the engaging members 12*d* of the supporting member 12 are engaged with the movable contact arm member 9 by means of the carrying pivot pin 15, the sliding movement of the elongated contact member 11 is restricted. Therefore, it is possible to align the contact of the elongated contact member 11 with the stationary contact 8 with great accuracy.

It should now be apparent that in accordance with the teachings of the present invention the movable contact arm assembly in compact and has a suitable mechanical strength since the supporting member, carried by the movable contact arm, is provided along the back of the elongated contact member.

Moreover, in accordance with the present invention no heating due to eddy currents nor humming or buzzing occurs in the contact arm assembly because the so-called shorting ring is not formed around the current flowing elongated contact member.

Furthermore, in accordance with one embodiment of this invention, it is possible to provide a movable contact arm assembly with a larger current capacity compared with prior type movable contact arm assemblies while being substantially the same size as the prior devices.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters of the United States is:

1. An electric switching device including at least one movable contact and means for moving said movable contact between the open and closed circuit positions comprising:

a movable contact arm having a pair of spaced wall portions including aligned holes therein, one end of said movable contact arm being provided with a hole;

an elongated contact member located between said wall portions of said contact arm;

a supporting member having at least one first generally L-shaped engaging member at one end thereof and including a first portion projecting from said supporting member and a second portion angled with respect to said first portion, said second portion engaged with said hole at one end of said movable contact arm and at least one engaging member at the other end thereof, said supporting member being mounted on said elongated contact member and being positioned between said elongated contact member and said movable contact arm; and a pivot pin passing through said aligned holes in said wall portions of said movable contact arm, whereby said at least one engaging member at the other end of said supporting member is engaged with said pivot pin.

2. An electric switching device as recited in claim 1, further comprising:

a compression spring located between said movable contact arm and said one end of said supporting member adjacent to said first L-shaped engaging member so as to bias said contact member away from said contact arm.

3. An electric switching device as recited in claim 1, wherein:

said movable contact arm includes additional aligned holes provided in said wall portions for interlocking with a second pivot pin.

4. An electric switching device as recited in claim 1, wherein:

said supporting member is rigid.

5. An electric switching device as recited in claim 1, wherein:

said supporting member is made of iron material.

6. An electric switching device as recited in claim 1, wherein said supporting member includes:

a second L-shaped engaging member such that said first and second L-shaped engaging members form a pair of generally L-shaped engaging members at said one end thereof; and said at least one engaging member comprising a pair of engaging members, each having a hole therein.

* * * * *